US011317215B2

(12) United States Patent
Guo et al.

(10) Patent No.: US 11,317,215 B2
(45) Date of Patent: Apr. 26, 2022

(54) LOUDSPEAKER DIAPHRAGM AND MOLDING METHOD THEREFOR

(71) Applicant: GOERTEK INC., Weifang (CN)

(72) Inventors: Xiaodong Guo, Weifang (CN); Guangtao Tian, Weifang (CN)

(73) Assignee: GOERTEK INC., Weifang (CN)

( * ) Notice: Subject to any disclaimer, the term of this patent is extended or adjusted under 35 U.S.C. 154(b) by 770 days.

(21) Appl. No.: 16/319,005

(22) PCT Filed: Dec. 20, 2016

(86) PCT No.: PCT/CN2016/111115
§ 371 (c)(1),
(2) Date: Jan. 18, 2019

(87) PCT Pub. No.: WO2018/014500
PCT Pub. Date: Jan. 25, 2018

(65) Prior Publication Data

US 2019/0281390 A1 Sep. 12, 2019

(30) Foreign Application Priority Data

Jul. 19, 2016 (CN) ..... 201610570297.4

(51) Int. Cl.
*H04R 7/14* (2006.01)
*H04R 9/06* (2006.01)

(52) U.S. Cl.
CPC ..... *H04R 7/14* (2013.01); *H04R 9/06* (2013.01); *H04R 2307/207* (2013.01)

(58) Field of Classification Search
CPC ..... H04R 7/14; H04R 9/06; H04R 2307/207; H04R 1/06; H04R 31/006; H04R 2231/001; H04R 2231/003; H04R 7/20
See application file for complete search history.

(56) References Cited

U.S. PATENT DOCUMENTS

2018/0091902 A1* 3/2018 Salvatti ..... H04R 9/045

FOREIGN PATENT DOCUMENTS

| | | | |
|---|---|---|---|
| CN | 101203065 A | | 6/2008 |
| CN | 202799123 U | | 3/2013 |
| CN | 104270707 A | | 1/2015 |
| CN | 204291373 U | * | 4/2015 |

(Continued)

*Primary Examiner* — Brian Ensey
(74) *Attorney, Agent, or Firm* — Saliwanchik, Lloyd & Eisenschenk

(57) ABSTRACT

A speaker diaphragm and a molding method therefor are provided. The speaker diaphragm comprises: a lead wire; a lead wire enclosure portion, wherein the lead wire enclosure portion has a membrane part and support protrusions, the support protrusions are distributed on a surface of the membrane part, the thickness of the membrane part is larger than or equal to the diameter of the lead wire, the thickness of the overall lead wire enclosure portion is larger than the diameter of the lead wire, and a part of the lead wire is injection-molded in the lead wire enclosure portion; and a diaphragm layer, wherein the diaphragm layer is configured to form an overall structure of the speaker diaphragm, the thickness of the diaphragm layer is larger than or equal to the thickness of the overall lead wire enclosure portion, and the lead wire enclosure portion is injection-molded in the diaphragm layer.

10 Claims, 2 Drawing Sheets

(56) References Cited

FOREIGN PATENT DOCUMENTS

| | | | |
|---|---|---|---|
| CN | 204291373 | U | 4/2015 |
| CN | 106060723 | A | 10/2016 |
| JP | 3052426 | B2 | 6/2000 |
| JP | 3879527 | B2 * | 2/2007 |

* cited by examiner

LOUDSPEAKER DIAPHRAGM AND MOLDING METHOD THEREFOR

CROSS REFERENCE TO RELATED APPLICATIONS

This application is a National Stage of International Application No. PCT/CN2016/111115, filed on Dec. 20, 2016, which claims priority to Chinese Patent Application No. 201610570297.4, filed on Jul. 19, 2016, both of which are hereby incorporated by reference in their entireties.

TECHNICAL FIELD

The present disclosure relates to the field of a processing technology for electronic devices, and in particular to a structure of a speaker diaphragm and a molding method therefor.

BACKGROUND

Micro-speakers are important devices in electronic products, and are widely used in earpieces and earphones of electronic devices such as mobile phones and tablet computers. Conventional micro-speakers usually adopt a moving-coil structure or a moving-iron structure. The speakers with the moving-coil structure are more widely used. With the gradual development of the electronic products, sound performance of the micro-speakers also needs to be improved.

The moving-coil speaker has a voice coil and a diaphragm. The voice coil receives a sound signal transmitted from an external device by a lead wire and generates vibration under an action of a magnetic field. The voice coil is connected to the diaphragm, and when the voice coil vibrates, the diaphragm will be driven to vibrate and generate sounds. However, since the lead wire usually extends from a shell of a speaker unit to the voice coil suspended in the middle of the speaker unit, when the voice coil vibrates, the lead wire may pull the voice coil and a vibrating portion of the diaphragm. Moreover, the vibration of the voice coil also causes the lead wire to vibrate, and the lead wire is enabled to collide against the shell of the speaker to generate noise. In both above cases, on one hand, degrees of freedom of the vibration of the diaphragm will be affected. On the other hand, with the noise generated, overall sound effects of the speaker will be affected by the lead wire.

Therefore, it is necessary to improve the structure of the moving-coil speaker, so as to reduce the noise generated by the collision between the lead wire and the shell, or reduce the pulling action of the lead wire on the diaphragm.

SUMMARY

An objective of the present disclosure is to provide a new technical solution of a speaker diaphragm.

According to a first aspect of the present disclosure, there is provided a speaker diaphragm, comprising: a lead wire; a lead wire enclosure portion, wherein the lead wire enclosure portion has a membrane part and support protrusions, the support protrusions are distributed on a surface of the membrane part, the thickness of the membrane part is larger than or equal to the diameter of the lead wire, the thickness of the overall lead wire enclosure portion is larger than the diameter of the lead wire, and a part of the lead wire is injection-molded in the lead wire enclosure portion; and a diaphragm layer, wherein the diaphragm layer is configured to form an overall structure of the speaker diaphragm, the thickness of the diaphragm layer is larger than or equal to the thickness of the overall lead wire enclosure portion, and the lead wire enclosure portion is injection-molded in the diaphragm layer.

Optionally, the diaphragm layer has a corrugated rim, the membrane part has an arcuate section corresponding to the corrugated rim, and the lead wire extends through the arcuate section.

Optionally, a part of the lead wire in the arcuate section has a bent structure.

Optionally, the diaphragm layer has a fixing portion located at the outer periphery of the corrugated rim and a central portion surrounded by the corrugated rim, the membrane part of the lead wire enclosure portion has a first plane corresponding to the fixing portion and a second plane corresponding to the central portion, and the lead wire extends through the first plane and the second plane.

Optionally, the lead wire is provided at a middle position in a thickness direction of the diaphragm layer.

Optionally, ends of the lead wire are electrically connected a bonding pad on a speaker shell and/or a speaker voice coil respectively.

Optionally, the speaker diaphragm comprises a composite layer, the composite layer is provided on the central portion, and an end of the lead wire is electrically connected to the composite layer.

Optionally, the lead wire in the speaker diaphragm comprises two or more than two lead wires.

The present disclosure further provides a processing method for a speaker diaphragm, comprising: injection-molding a lead wire enclosure portion on a part of a lead wire, wherein the lead wire enclosure portion has a membrane part and support protrusions, the thickness of the membrane part is larger than or equal to a diameter of the lead wire, and the thickness of the lead wire enclosure portion is larger than the diameter of the lead wire; and injection-molding a diaphragm layer over the lead wire enclosure portion and the lead wire to form an overall shape of the speaker diaphragm, the thickness of the diaphragm layer being larger than the thickness of the overall lead wire enclosure portion.

Optionally, when the lead wire enclosure portion is injection-molded, the membrane part is injection-molded into a planar structure, and when the diaphragm layer is injection-molded, a corrugated rim is formed on the diaphragm layer, and a part of the membrane part positionally corresponding to the corrugated rim forms an arcuate section matched with a structure of the corrugated rim.

The inventors of the present disclosure have found that in the prior art, the technology of the moving-coil speaker is relatively mature. The lead wires of the conventional moving-coil speaker are all provided outside of the diaphragm. Since such basic structure is relatively mature, those skilled in the art will not modify these basic structures when using the moving-coil structure. For the collision noise generated by the lead wires, those skilled in the art generally will make improvements in other structural aspects to reduce the noise. However, the present disclosure has improved the conventional basic structure. Therefore, the technical task to be achieved or the technical problem to be solved by the present disclosure is never conceived or expected by those skilled in the art, thus the present disclosure is a new technical solution.

Further features of the present disclosure and advantages thereof will become apparent from the following detailed description of exemplary embodiments according to the present disclosure with reference to the attached drawings.

BRIEF DESCRIPTION OF THE DRAWINGS

The accompanying drawings, which are incorporated in and constitute a part of the specification, illustrate embodiments of the disclosure and, together with the description thereof, serve to explain the principles of the disclosure.

DETAILED DESCRIPTION

Figure 1:
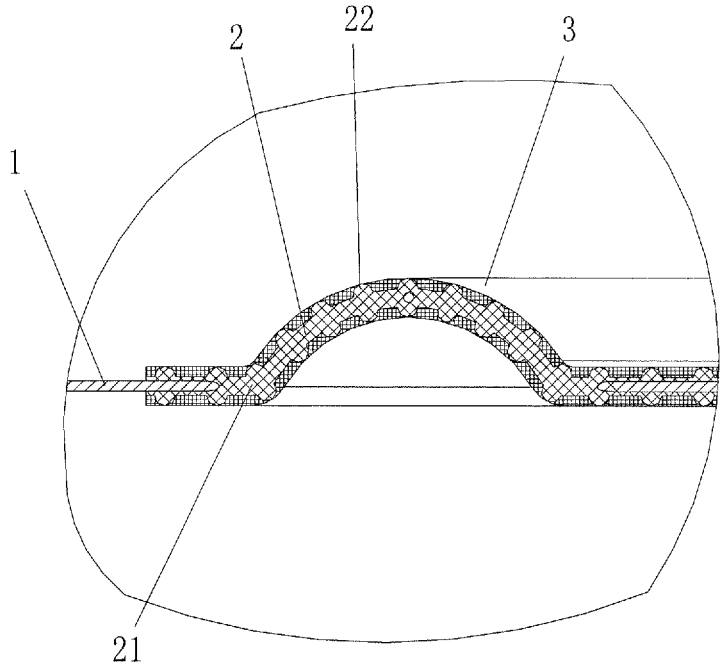
FIG. 1 is a partial side cross-sectional view of a speaker diaphragm provided by the present disclosure.

The present disclosure will be described in detail below in conjunction with the specific embodiments shown in the drawings. However, the embodiments are not intended to limit the present disclosure, and the transformations on the structures, methods, or functions made by those ordinary skilled in the art in accordance with the embodiments are included in the scope of the present disclosure.

Various exemplary embodiments of the present disclosure will now be described in detail with reference to the drawings. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit the disclosure, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

The present disclosure provides an improved speaker diaphragm, and such speaker diaphragm encloses a lead wire therein. The lead wire does not collide against a speaker shell when the diaphragm vibrates, thereby eliminating the noise generated by the collision of the lead wire and the speaker shell. The speaker diaphragm provided by the present disclosure at least comprises the lead wire, a lead wire enclosure portion and a diaphragm layer. As shown in FIG. 1, the lead wire enclosure portion 2 has a membrane part 21 and support protrusions 22. The membrane part 21 is a diaphragm layer formed by soft rubber material, and can have a bent or a curved surface matched with the whole shape of the speaker diaphragm. The support protrusions 22 are uniformly distributed on a surface of the membrane part 21. The support protrusions 22 have a certain height. Preferably, the support protrusions 22 are distributed on both front and back surfaces of the membrane part 21. In particular, part of the structure of the lead wire 1 is injection-molded in the lead wire enclosure portion 2, that is, a length of the lead wire 1 extends in the membrane part 21 or on the surface of the membrane part 21. As shown in FIG. 1, the thickness of the membrane part 21 is larger than or equal to the diameter of the lead wire 1, and the support protrusions 22 protrude upward for a certain height from the surface of the membrane part 21. In this way, the thickness of the overall lead wire enclosure portion 2 is larger than the diameter of the lead wire 1, that is, the thickness of the membrane part 21 plus the protruding height of the support protrusion 22 is larger than the diameter of the lead wire.

The above thickness limitation on the lead wire enclosure portion is to ensure that the lead wire can be injection-molded into the lead wire enclosure portion. When the lead wire enclosure portion is injection-molded around the lead wire, since the thickness of the membrane part is larger than or equal to the diameter of the lead wire, the lead wire can be completely embedded in the membrane part, or the lead wire can be exposed from the surface of the membrane part. However, no matter what happens during the injection molding, the part of the lead wire exposed from the membrane part will not be higher than the support protrusions.

Further, the speaker diaphragm provided by the present disclosure further comprises a diaphragm layer. The diaphragm layer is configured to form an overall structure and shape of the speaker diaphragm. For example, a diaphragm of a moving-coil type speaker is generally annular and is provided with a corrugated rim thereon, and the diaphragm layer as a whole can have an annular structure having a corrugated rim. Particularly, as shown in FIG. 1, the thickness of the diaphragm layer 3 should be larger than or equal to the thickness of the overall lead wire enclosure portion 2, and the lead wire enclosure portion 2 is injection-molded in the diaphragm layer 3. Due to the above thickness limitation to the diaphragm layer 3, as well as supporting and raising actions of the support protrusions 22 on the membrane part 21, when the diaphragm layer 3 is injection-molded over the lead wire enclosure portion 2, the membrane part 21 of the lead wire enclosure portion 2 and the lead wire 1 therein will be completely embedded inside the diaphragm layer 3, and not exposed from a surface of the diaphragm layer 3. The support protrusions can be completely embedded in the diaphragm layer, or only top ends of the support protrusions may be exposed from the surface of the diaphragm layer, but performance of the speaker diaphragm is not affected.

Optionally, a structure of the support protrusions can be a hemispherical or cylindrical body. It is not easy for the hemispherical support protrusions to be exposed from the diaphragm layer, while the cylindrical support protrusions can provide a more stable support. The support protrusions of different structures have different performances in terms of support, prevention of exposure, etc., which can be selected by those skilled in the art according to actual conditions.

The present disclosure achieves that the lead wire of the speaker is completely embedded in the diaphragm by improving the structure of the speaker diaphragm, the collision between the lead wire and the speaker shell can be prevented, and the noise generated by the collision is eliminated. If instead of enclosing the lead wire by the lead wire enclosure portion designed by the present disclosure, the overall structure of the diaphragm is directly injection-molded around the lead wire, the lead wire is likely to be exposed from a side surface or even both side surfaces of the diaphragm due to a limited injection molding process and possible undulations of the lead wire. However, the speaker diaphragm according to the present disclosure adopts a two-part structure, the lead wire enclosure portion firstly encloses the lead wire preliminarily, and the lead wire can be exposed from the surface of the membrane part. Further, the support protrusions on the membrane part cooperate with an injection mold to lift the membrane part overhead, so that the diaphragm layer completely encloses the membrane part, and the lead wire in the membrane part is completely embedded in the diaphragm layer, without being exposed from the surface of the diaphragm layer.

Figure 2:
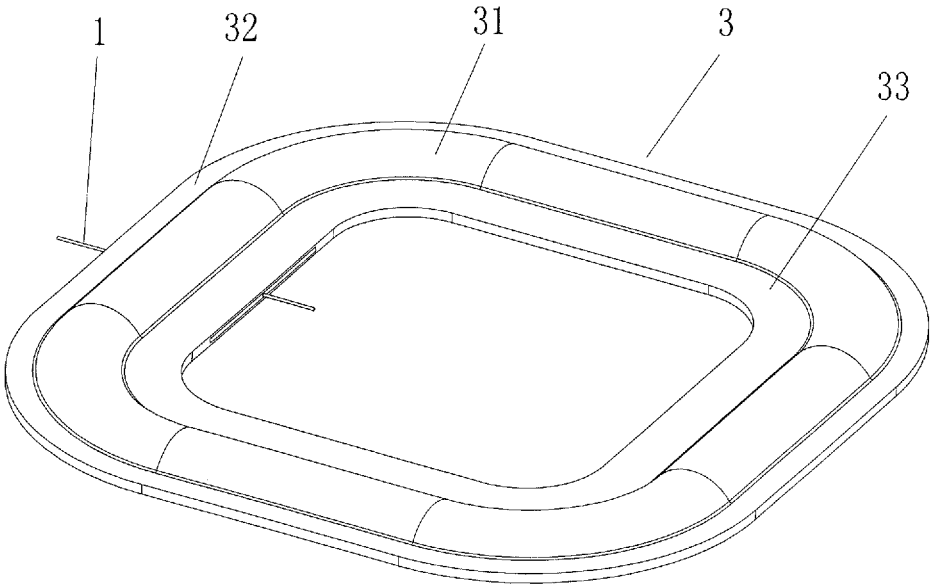
FIG. 2 is a schematic diagram of an overall structure of the speaker diaphragm provided by the present disclosure.
Figure 3:
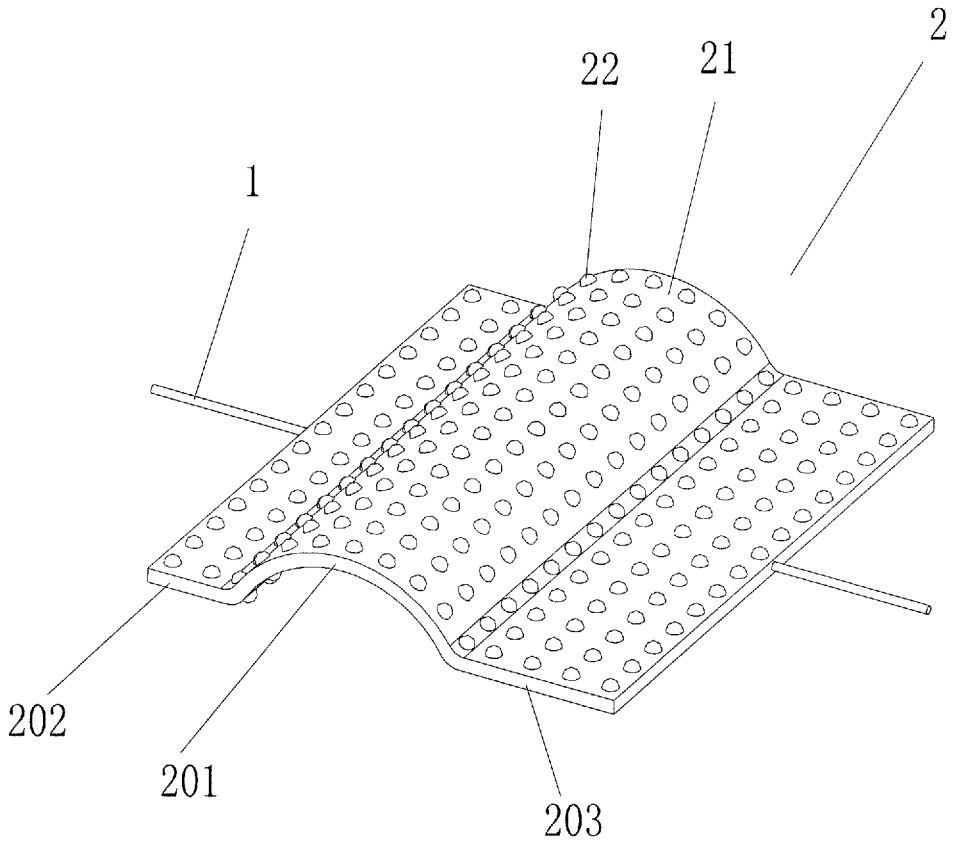
FIG. 3 is a schematic structural diagram of a lead wire enclosure portion and a lead wire provided by the present disclosure.

Specifically, as shown in FIG. 2 and FIG. 3, in order to adapt to vibration performance of the speaker diaphragm, the diaphragm layer 3 can have the corrugated rim 31. Accordingly, the membrane part 21 of the lead wire enclosure portion 2 can have an arcuate section corresponding to a structure of the corrugated rim 31. According to different functions of the lead wire 1 in the speaker diaphragm, the lead wire 1 can extend through the arcuate section 201, or can extend only in a region outside the arcuate section 201 without passing through the arcuate section 201, which is not limited by the present disclosure. In the embodiment shown in FIG. 2 and FIG. 3, the lead wire 1 can be configured to be electrically connected to a voice coil of the speaker. Therefore, the lead wire 1 runs in from an outer periphery of the diaphragm layer 3, passes through the corrugated rim 31 and hence the arcuate section 201, and then runs out from a central region of the diaphragm layer 3.

Figure 4:
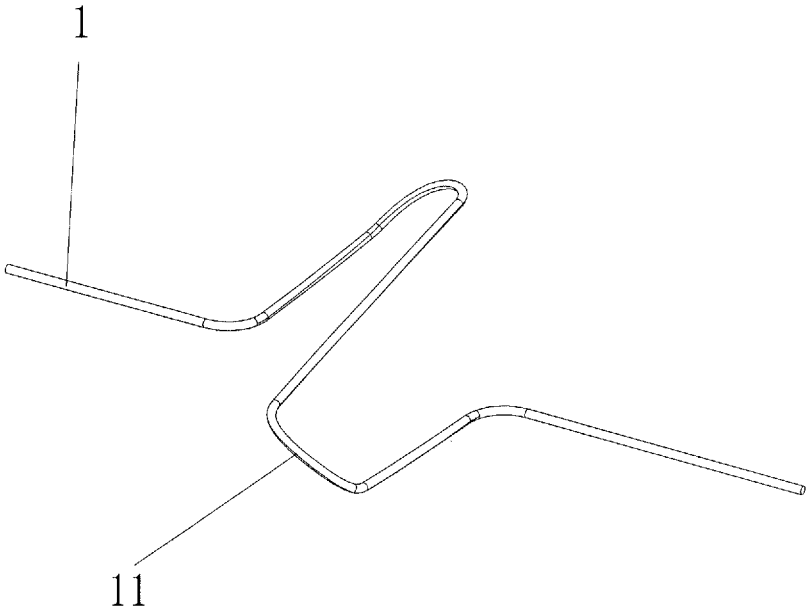
FIG. 4 is a schematic structural diagram of the lead wire provided by the present disclosure.

When the speaker diaphragm practically works, the corrugated rim of the diaphragm will stretch and contract, resulting in deformations causing a curvature of the corrugated rim to be changed during vibration processes, and such deformations of the corrugated rim is to enable better vibrations of a central region of the diaphragm. In the present disclosure, for an embodiment in which the lead wire extends through the arcuate section, when the corrugated rim and hence the arcuate section are deformed, the lead wire may limit such deformations, so that the corrugated rim and hence the arcuate section cannot vibrate along with the voice coil to achieve ideal deformations. Moreover, if the action force of the deformation is relatively large, the lead wire in the arcuate section can be damaged. In order to prevent the above phenomenon, as shown in FIG. 4, in a preferable embodiment of the present disclosure, a part of the lead wire 1 in the arcuate section 201 preferably has a bent structure 11. The lead wire 1 having the bent structure 11 does not extend along a straight line, but can be bent toward the extending direction of the corrugated rim 31 and hence the arcuate section 201, to form an S shape or other bent extending forms. After extending out of the arcuate section 201, the lead wire 1 can again extend along the straight line. The bent structure 11 increases the length of the lead wire 1 in the arcuate section 201 and increases the deformability of the lead wire 1 in the arcuate section 201. When the corrugated rim 31 and then the arcuate section 201 are deformed, the lead wire 1 having the bent structure 11 can be deformed therewith, thereby reducing an influence of the lead wire on the corrugated rim 31 and then the arcuate section 201, and avoiding to tear apart the lead wire 1.

Further, in the embodiment of the present disclosure, as shown in FIG. 2, the diaphragm layer 3 can have a fixing portion 32 located at an outer periphery of the corrugated rim 31 and a central portion 33 surrounded by the corrugated rim 31. The fixing portion 32 is configured to be fixedly connected to the speaker shell. The central portion 33 is configured to generate vibrations during operation. Accordingly, in order to ensure that the lead wire 1 can be completely embedded in the diaphragm layer 3, the membrane part 21 of the lead wire enclosure portion 2 can have a first plane 202 corresponding to the fixing portion 32, and a second plane 203 corresponding to the central portion 33, as shown in FIG. 3. The lead wire 1 runs into the lead wire enclosure portion 2 from the first plane 202. After passing through the arcuate section 201, the lead wire 1 runs out from the second plane 203.

In addition, the present disclosure does not limit that the lead wire enclosure portion 2 must have the arcuate section 201. In the embodiment as shown in FIG. 2 and FIG. 3, the lead wire 1 needs to pass through the corrugated rim 31 of the diaphragm layer 3 to further extend to the central region of the diaphragm layer 3. Therefore, the lead wire enclosure portion 2 needs to have the arcuate section 201. In other embodiments, the lead wire configured for other applications may do not need to pass through the corrugated rim 31 of the diaphragm layer 3. Accordingly, the lead wire enclosure portion does not need to have the arcuate section 201 corresponding to the corrugated rim 31.

Preferably, the speaker diaphragm can comprise a composite layer. The composite layer is provided on the central portion. The composite layer as a weight can improve vibration stability of the central portion of the diaphragm layer. On the other hand, other electronic devices or electrical connection points can be provided on the composite layer, to realize other electrical functions. Optionally, the lead wire can be electrically connected to the composite layer for transmitting related electrical signals to the composite layer, thereby achieving functions related to the composite layer.

Preferably, in order to improve structural stability and vibration balance performance of the speaker diaphragm, the lead wire 1 and the lead wire enclosure portion 2 can be located at a middle position in a thickness direction of the diaphragm layer 3, that is, the lead wire 1 is located at a middle thickness position of the diaphragm layer 3, as shown in FIG. 4. Thus, the center of gravity of the speaker diaphragm is centered, and upward or downward polarization phenomenon is less likely to occur.

Both ends of the lead wire are electrically connected to different devices respectively to achieve signal conduction. Optionally, an end of the lead wire can be soldered to a bonding pad on the speaker shell to introduce an external electrical signal into the speaker. The other end of the lead wire can be connected to the voice coil of the speaker to provide an acoustic signal for the voice coil. The present disclosure does not specifically limit a type of the devices electrically connected to the lead wire. In a specific embodiment of the present disclosure, those skilled in the art can connect the lead wire to specific components according to different functions configured for the lead wire. In particular, the lead wire can be electrically connected to the electrical components before the lead wire is injection-molded to the lead wire enclosure portion. For example, if the two ends of the lead wire need to be electrically connected to an elastic piece disposed in the speaker shell and the composite layer disposed on the speaker diaphragm, the lead wire can be soldered to the elastic piece and the composite layer at first, and then the lead wire, the elastic piece and the composite layer are placed in an injection mold of the lead wire enclosure portion together.

Optionally, the number of lead wires embedded in the speaker diaphragm is larger than or equal to two. Generally, two lead wires may form a signal loop with the voice coil of the speaker. However, in some embodiments of the present disclosure, structures such as the composite layer on the diaphragm are also configured to have other functions. Therefore, more lead wires and corresponding lead wire enclosure portions can be provided on the speaker diaphragm for electrical connections with other devices. For example, some of the lead wires can be electrically connected to the composite layer or electrically connected to a centering support piece of the speaker diaphragm.

The present disclosure also provides a processing method for a speaker diaphragm. Such processing method can process the speaker diaphragm provided by the present disclosure.

The method comprises: firstly, placing a lead wire into a first injection mold, wherein the first injection mold is configured for injection molding a lead wire enclosure portion on a part of the lead wire. The part of the lead wire refers to that located inside a diaphragm layer. In particular, the height of a space in the first injection mold for injection-molding a membrane part should be larger than or equal to the diameter of the lead wire, and the lead wire is placed in the space. Thus, even if the lead wire has floated to some extent during the injection molding, the lead wire can be basically covered by the membrane part. The lead wire can be exposed from an upper surface or a lower surface of the membrane part. In addition, pits are provided in the first injection mold, and support protrusions can be formed by filling the pits with injection molding material. The depth of the pits plus the height of the space should be larger than the diameter of the lead wire, such that the thickness of the overall lead wire enclosure portion injection-molded is larger than the diameter of the lead wire, and part of the lead wire exposed from the membrane part will not be higher than top ends of the support protrusions.

Further, the lead wire and the injection-molded lead wire enclosure portion are placed in a second injection mold, and the second injection mold is configured to form an overall structure of the diaphragm layer. In the second injection mold, the height of a space for injection-molding the diaphragm layer should be larger than or equal to the thickness of the overall lead wire enclosure portion. In this way, injection molding material can be filled onto upper and lower surfaces of the lead wire enclosure portion and regions among the support protrusions, to completely cover the membrane part and even the support protrusions. During the injection molding process, the lead wire enclosure portion may have floated to some extent, which may cause that the support protrusions are not completely covered by the diaphragm layer, but such case will not affect performance of the diaphragm. By such processing method, the lead wire enclosed by the lead wire enclosure portion can be completely embedded in the diaphragm layer, thereby ensuring that the lead wire is not exposed.

Optionally, a corrugated rim can be formed on the diaphragm layer to enhance vibration performance of the overall speaker diaphragm. Accordingly, if the lead wire passes through a area of the corrugated rim, the membrane part of the lead wire enclosure portion needs to have an arcuate section matched with a structure of the corrugated rim. For this purpose, when the lead wire enclosure portion is injection-molded, the membrane part can be directly injection-molded into having the arcuate section, and the lead wire extends through the arcuate section. Thereafter, the lead wire enclosure portion and the lead wire are placed in the second injection mold. In particular, a position of the arcuate section should correspond to a position of a bent part in the second injection mold for the injection molding of the corrugated rim. In this way, the corrugated rim of the diaphragm layer is formed on a surface of the arcuate section during injection molding.

Optionally, molding material of the lead wire enclosure portion and the diaphragm layer can be selected as silica gel material. Since the lead wire enclosure portion is required to be subjected to a second injection molding process in the second injection mold, the hardness of the material for forming the lead wire enclosure portion is preferably lower than that of material of the diaphragm layer, so as to enable the second injection molding process. The hardness of the material of the diaphragm layer is relatively high, thereby providing a better support and contour for the whole speaker diaphragm.

The present disclosure also provides another processing method of the arcuate section and the corrugated rim. As described above, the arcuate section can be formed on the membrane part in advance. However, if there is an error existing between a structure of the arcuate section and a structure of the second injection mold, the finally formed corrugated rim and arcuate section may have structural defects such as an offset and inclination, and acoustic performance of products is in turn reduced. Therefore, preferably, when the lead wire enclosure portion is injection-molded, the membrane part can be injection-molded into a planar structure at first, and then the lead wire enclosure portion is directly placed in the second injection mold. The second injection mold has a bent part for forming the corrugated rim therein. When the lead wire enclosure portion is press-fitted into the second injection mold, the bent part in the second injection mold directly presses a part of the membrane part into the arcuate section. An injection molding of the diaphragm layer is performed under a press-fitting restriction of the second injection mold. In the finally formed speaker diaphragm, the membrane part can form the contoured arcuate section. The corrugated rim completely matched with the contour of the arcuate section is formed on the surface of the arcuate section. In this way, the arcuate section and the corrugated rim are completely matched in shape and structure, and the defects of inclination and offset are avoided. According to the above processing method provided by the present disclosure, the arcuate section for the lead wire enclosure portion and the corrugated rim for the diaphragm layer are formed directly by one injection molding process, thereby improving the quality of the speaker diaphragm.

Although some specific embodiments of the present disclosure have been demonstrated in detail with examples, it should be understood by a person skilled in the art that the above examples are only intended to be illustrative but not to limit the scope of the present disclosure. It should be understood by those skilled in the art that the above embodiments could be modified without departing from the scope and spirit of the present disclosure. The scope of the present disclosure is defined by the appended claims.

The invention claimed is:

1. A speaker diaphragm, comprising:

a lead wire;

a lead wire enclosure portion, wherein the lead wire enclosure portion has a membrane part and support protrusions, the support protrusions are distributed on a surface of the membrane part, the thickness of the membrane part is larger than or equal to the diameter of the lead wire, the thickness of the overall lead wire enclosure portion is larger than the diameter of the lead wire, and a part of the lead wire is injection-molded in the lead wire enclosure portion; and a diaphragm layer, wherein the diaphragm layer is configured to form an overall structure of the speaker diaphragm, the thickness of the diaphragm layer is larger than or equal to the thickness of the overall lead wire enclosure portion, and the lead wire enclosure portion is injection-molded in the diaphragm layer.

2. The speaker diaphragm according to claim 1, wherein the diaphragm layer has a corrugated rim, the membrane part has an arcuate section corresponding to the corrugated rim, and the lead wire extends through the arcuate section.

3. The speaker diaphragm according to claim 2, wherein a part of the lead wire in the arcuate section has a bent structure.

4. The speaker diaphragm according to claim 2, wherein the diaphragm layer has a fixing portion located at an outer periphery of the corrugated rim and a central portion surrounded by the corrugated rim, the membrane part of the lead wire enclosure portion has a first plane corresponding to the fixing portion and a second plane corresponding to the central portion, and the lead wire extends through the first plane and the second plane.

5. The speaker diaphragm according to claim 1, wherein the lead wire is provided at a middle position in a thickness direction of the diaphragm layer.

6. The speaker diaphragm according to claim 1, wherein ends of the lead wire are electrically connected a bonding pad on a speaker shell and/or a speaker voice coil respectively.

7. The speaker diaphragm according to claim 4, wherein the speaker diaphragm comprises a composite layer, the composite layer is provided on the central portion, and an end of the lead wire is electrically connected to the composite layer.

8. The speaker diaphragm according to claim 1, wherein the lead wire comprises two or more than two lead wires.

9. A processing method for a speaker diaphragm, comprising:

injection-molding a lead wire enclosure portion on part of a lead wire, wherein the lead wire enclosure portion has a membrane part and support protrusions, the thickness of the membrane part is larger than or equal to the diameter of the lead wire, and the thickness of the overall lead wire enclosure portion is larger than the diameter of the lead wire; and injection-molding a diaphragm layer over the lead wire enclosure portion and the lead wire to form an overall shape of the speaker diaphragm, the thickness of the diaphragm layer being larger than the thickness of the overall lead wire enclosure portion.

10. The processing method according to claim 9, wherein when the lead wire enclosure portion is injection-molded, the membrane part is injection-molded into a planar structure, and when the diaphragm layer is injection-molded, a corrugated rim is formed on the diaphragm layer, and a section of the membrane part positionally corresponding to the corrugated rim forms an arcuate section matched with a structure of the corrugated rim.

* * * * *